US007213281B2

(12) United States Patent
Hahn et al.

(10) Patent No.: US 7,213,281 B2
(45) Date of Patent: May 8, 2007

(54) INFANT SAFETY SYSTEM

(75) Inventors: Ricardo Hahn, Sierra Madre, CA (US); Raymond Peck, Los Angeles, CA (US); Lynda Marie Knox, Long Beach, CA (US)

(73) Assignee: Alfred E. Mann Institute for Biomedical Engineering at the University of Southern California, Los Angeles, CA (US)

( * ) Notice: Subject to any disclaimer, the term of this patent is extended or adjusted under 35 U.S.C. 154(b) by 0 days.

(21) Appl. No.: 11/157,083

(22) Filed: Jun. 20, 2005

(65) Prior Publication Data

US 2005/0283915 A1 Dec. 29, 2005

Related U.S. Application Data

(60) Provisional application No. 60/606,369, filed on Sep. 1, 2004, provisional application No. 60/592,207, filed on Jul. 29, 2004, provisional application No. 60/581,402, filed on Jun. 21, 2004.

(51) Int. Cl.
*A47G 9/00* (2006.01)
*A47D 13/00* (2006.01)

(52) U.S. Cl. ..... 5/655; 5/922; 128/845

(58) Field of Classification Search ..... 5/655, 5/732, 603, 922, 424, 425; 128/845
See application file for complete search history.

(56) References Cited

U.S. PATENT DOCUMENTS 4,095,299 A * 6/1978 Schweiso ..... 5/658
D259,458 S * 6/1981 Fuller et al. ..... D6/596
4,825,487 A * 5/1989 Eberl ..... 5/655
5,189,748 A * 3/1993 Garrison et al. ..... 5/655
5,272,780 A * 12/1993 Clute ..... 5/655
5,310,245 A * 5/1994 Lyszczasz ..... 297/219.12
5,341,531 A * 8/1994 Straub et al. ..... 5/655
5,367,730 A * 11/1994 Sher ..... 5/655
5,548,858 A * 8/1996 Shoa ..... 5/413 R
5,581,832 A * 12/1996 Bridley ..... 5/655
5,937,461 A * 8/1999 Dombrowski et al. ..... 5/655
5,957,692 A * 9/1999 McCracken et al. ..... 434/159
6,292,964 B1 * 9/2001 Rose et al. ..... 5/630
6,381,787 B1 * 5/2002 Rogone et al. ..... 5/655
6,473,923 B1 * 11/2002 Straub ..... 5/655
6,877,176 B2 * 4/2005 Houghteling ..... 5/655
2002/0042954 A1 * 4/2002 Straub ..... 5/655
2002/0133881 A1 * 9/2002 Vrbas et al. ..... 5/655
2003/0145384 A1 * 8/2003 Stelnicki ..... 5/655
2004/0060117 A1 * 4/2004 Chan ..... 5/655
2006/0010604 A1 * 1/2006 Kamrin-Balfour ..... 5/655

* cited by examiner

*Primary Examiner*—Alexander Grosz
(74) *Attorney, Agent, or Firm*—Marc E. Brown; McDermott Will & Emery, LLP

(57) ABSTRACT

An infant positioner and positioning system, and methods of use and manufacture, are disclosed for preventing SIDS, plagiocephaly, torticolli, or suffocation from regurgitation. The device and system includes an infant positioner with a concave back support and abdominal support for positioning an infant on its side. A position marker can also indicate how to position the infant within the infant positioner.

5 Claims, 2 Drawing Sheets

INFANT SAFETY SYSTEM

CROSS REFERENCE TO RELATED APPLICATIONS

This application is related to and claims the benefit of the filing date of U.S. provisional applications Ser. Nos. 60/581,402, filed Jun. 21, 2004 by Ricardo Hahn and entitled "Infant Positioner Mattress," 60/592,207, filed Jul. 29, 2004 by Ricardo Hahn and entitled "Infant Positioner Mattress," and 60/606,369, filed Sep. 1, 2004 by Ricardo Hahn and entitled "Infant Positioner Mattress," the contents of all three applications are incorporated herein by reference.

BACKGROUND OF THE INVENTION

1. Field of the Invention

The application relates to infant positioners for positioning an infant while sleeping, and relates more particularly to positioners and accessories for reducing the risk of sudden infant death, positional plagiocephaly, and other conditions.

2. General Background and State of the Art

Medical studies have shown that infants who sleep on their backs have a reduced risk of dying suddenly from Sudden Infant Death Syndrome (SIDS), compared to infants who sleep on their stomachs. Efforts by the American Academy of Pediatrics to disseminate this information to pediatricians and parents have resulted in an increase in the practice of placing infants in a supine position for sleeping.

An unanticipated effect of the increasingly widespread practice of placing infants in a supine position for sleeping has been an increase in the number of infants developing positional plagiocephaly, i.e., a flat or misshapen area on the back of the skull. A newborn infant's skull is relatively deformable due to flexibility of the bone plates and non-fusion of the sutures between adjacent bone plates. This property of deformability permits the infant's head to pass between the bones of the mother's pelvis during birth. As the infant matures, however, the bone plates of the skull become increasingly rigid and the sutures eventually fuse.

When an infant spends many hours daily sleeping exclusively on his back, the bones at the back of the skull tend to flatten from pressure against the sleeping surface due to the weight of the infant's head. If the practice of sleeping exclusively on the back is continued through the critical period during which the bones of the skull become rigid, the flat or misshapen area on the back of the skull can become permanent.

Furthermore, if an infant spends prolonged periods sleeping on the same side of its body, plagiocephaly may occur on the side of the infant's head. The occurrence of plagiocephaly on a side of the infant's head may cause the infant's ear to gradually move toward the nose. Infants may spend prolonged periods sleeping on one side of their head if the infants are repeatedly laid on the same side when placed onto a mattress or pillow. Infants may regularly be placed on their same side since the guardian's may not know that they can reduce the risk of plagiocephaly by alternating the position of the infant when placing the infant on a mattress or pillow. Furthermore, knowledgeable guardians may repeatedly place the infant on its same side since guardians may forget which side the infant was last placed upon.

SUMMARY

In one aspect of the infant positioner, an infant positioner for positioning an infant on its side comprises a first downwardly sloping concave surface oriented to provide substantial support to the back of an infant placed on it and having a steepness sufficient to prevent the baby from lying in a supine position; and a second surface configured to support the stomach and/or chest of an infant and having a surface of sufficient size and firmness to prevent the infant from rolling over onto its stomach.

In another aspect of the infant positioner, a method of preventing plagiocephaly while an infant rests or sleeps on an infant positioner that is configured to substantially prevent the infant from moving from its position comprises placing an infant on its first side on the positioner so that its head is located at a first end of the positioner and its legs are positioned at a second end of the positioner; allowing the infant to rest in that position for a time; and placing the infant on its second side on the positioner so that its head is located at the second end of the positioner and its legs are positioned at the first end of the positioner.

By way of example, this system may be useful in positioning an infant on its alternating sides to prevent SIDS, plagiocephaly, torticolli, suffocation from reflux, and other conditions. Preferred embodiments are also useful in reminding the user how to orient the infant on its alternating sides upon repeated use of the positioner.

It is understood that other embodiments of the present invention will become readily apparent to those skilled in the art from the following detailed description, wherein it is shown and described only exemplary embodiments of the invention by way of illustration. As will be realized, the invention is capable of other and different embodiments and its several details are capable of modification in various other respects, all without departing from the spirit and scope of the present invention. Accordingly, the drawings and detailed description are to be regarded as illustrative in nature and not as restrictive.

BRIEF DESCRIPTION OF THE DRAWINGS

Aspects of the present invention are illustrated by way of example, and not by way of limitation, in the accompanying drawings, wherein.

DETAILED DESCRIPTION OF THE DRAWINGS

The detailed description set forth below in connection with the appended drawings is intended as a description of exemplary embodiments of the present invention and is not intended to represent the only embodiments in which the present invention can be practiced. The term "exemplary" used throughout this description means "serving as an example, instance, or illustration," and should not necessarily be construed as preferred or advantageous over other embodiments. The detailed description includes specific details for the purpose of providing a thorough understanding of the present invention. However, it will be apparent to those skilled in the art that the present invention may be practiced without these specific details. In some instances, well-known structures and devices are shown in block diagram form in order to avoid obscuring the concepts of the present invention.

Figure 1:
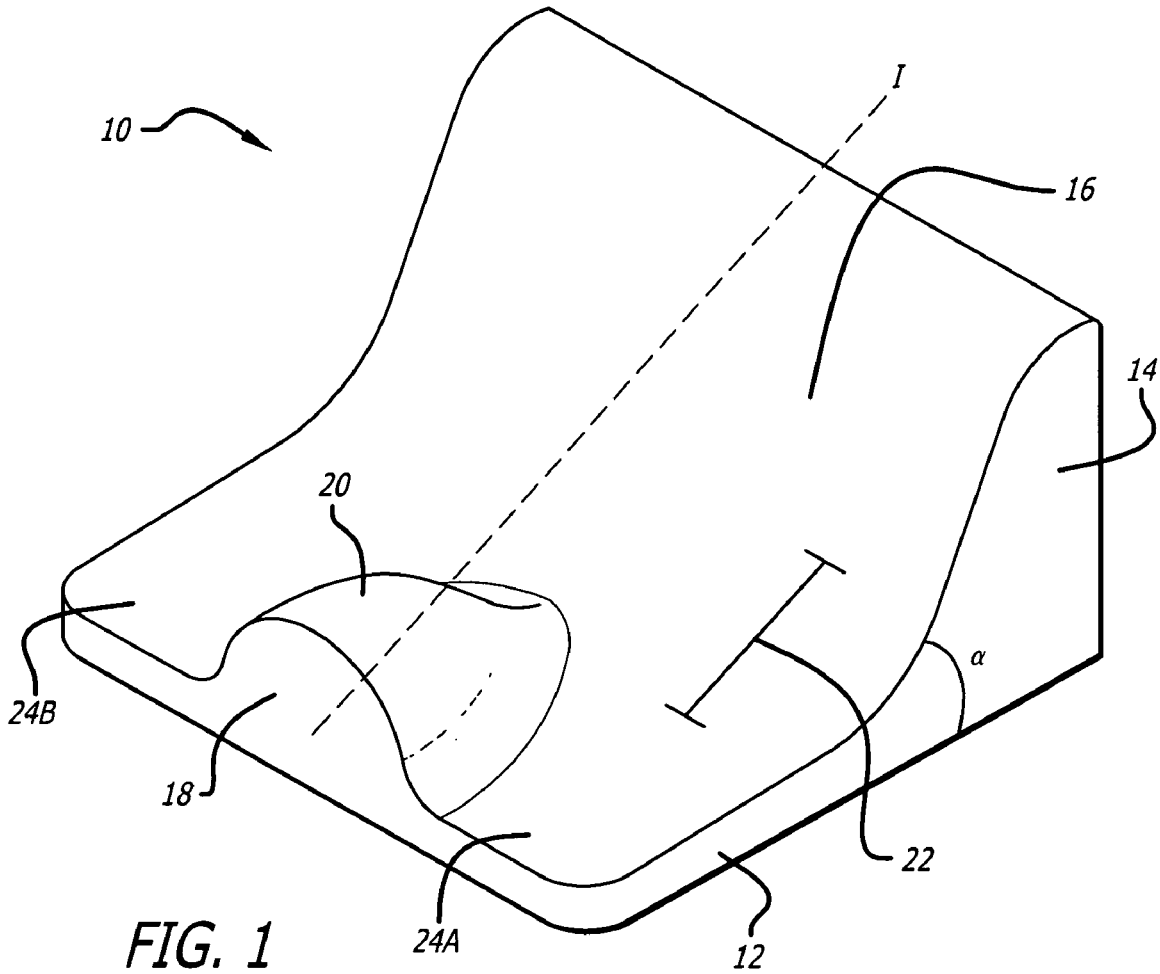
FIG. 1 illustrates an exemplary embodiment of an infant positioner.
Figure 2:
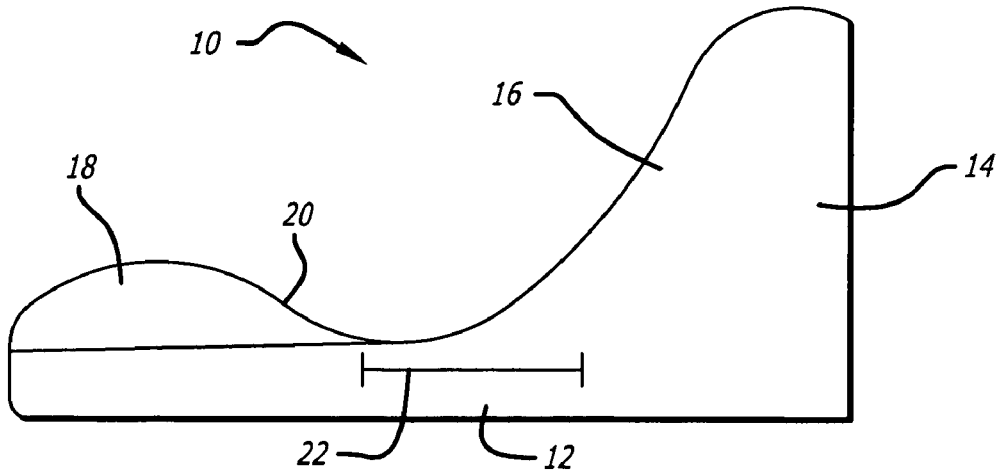
FIG. 2 illustrates a side view of the infant positioner of FIG. 1.
Figure 3:
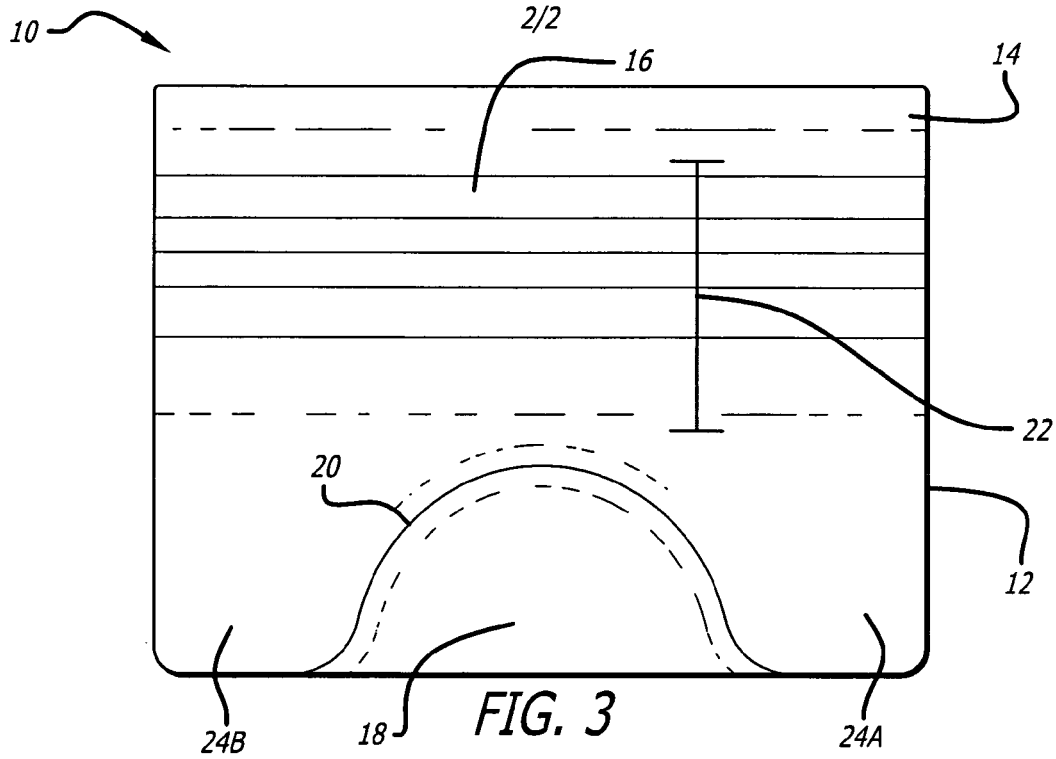
FIG. 3 is top view of the infant positioner of FIG. 1.

FIGS. 1–4 illustrate an exemplary infant positioner 10 that causes the infant to be positioned on the infant's side when placed in the infant positioner 10. The positioner has a base 12, an infant back support 14, and an infant abdomen support 18. The abdominal support 18 preferably supports the stomach and chest of the infant, and the back support 14 supports the back of the infant. The infant back support 14 and an infant abdomen support 18 are configured on the base 12 to form a cradle segment 22 located between the back support 14 and the abdomen support 18. In FIGS. 1 and 2, the concave cradle segment 22 preferably includes a portion of the front upwardly sloping surface 20 of the abdomen support 18, a portion of base 12, and a portion of the contacting downwardly sloping surface 16 of the back support 14. The sloping surfaces 16 and 20 are part of a continuous surface and do not contain any substantially flat portion between them. The base 12 can have a planar bottom surface.

When placed in the positioner 10, the back support 14 and the abdomen support 18 can position the infant on the infant's side so that the side of the infant's head contacts cradle segment 22 of the positioner 10. The two sides of the infant positioner 10 defined by Axis I can be symmetrically shaped, thereby allowing the infant to be positioned on alternating sides of the infant.

The base 12 can be substantially rectangular in shape. The base 12, back support 14, abdomen support 18, and cradle segment 22 can be of sufficient dimensions and firmness to support and position infants ranging in age from newly born to about three months old. Other positioners can have dimensions and firmness to support and position infants ranging in age from three months old to about two years old.

The back support 14 is configured to support the back of the infant, and can have a contacting surface 16 sized to prevent the infant from rolling over onto its back. For example, as shown in FIG. 1 the contacting surface 16 of the back support 14 is at an angle $\alpha$ to the base member 12, where the angle $\alpha$ is sufficiently large to prevent the infant from rolling onto its back.

For example, the infant positioner 10 can have an angle $\alpha$ ranging between 30 degrees and 90 degrees, formed between the contacting surface 16 of the back support 14 back and base 12. More specifically, the angle $\alpha$ can also range in value between 35 to 60 degrees. The noted angles are only exemplary, and other angles between the contacting surface 16 of the back support 14 and base 12 are envisioned.

The abdominal support 18 is configured to support the stomach and chest of the infant, having a front surface 20 of sufficient size and firmness to prevent the infant from rolling over onto its stomach. For example, as shown in FIG. 1, the front surface 20 of the abdominal support 18 can be configured to the support the stomach and chest of the infant substantially perpendicular to the base 12, where a portion the front surface 20 is concave, being molded to fit against the chest and abdomen of the infant.

The portions of the base 12 that flank the abdominal support 18 form arm/leg support segments 24*a* and 24*b*. For example, when the infant is positioned as in FIG. 4, the infant's hands and arms can rest comfortably on or near arm/leg support segment 24*a*, while the infant's legs or feet can rest on or near arm/leg support segment 24*b*. Alternatively, when the infant's position is reversed, the infant's hands and arms can rest comfortably on or near arm/leg support segment 24*b*, while the infant's legs or feet can rest on or near arm/leg support segment 24*a*. The arm/leg support segments 24*a* and 24*b* may prevent the infant's arms and legs from contacting surfaces outside of the infant positioner 10.

The infant positioner 10 can be made of a substantially firm foam material, sufficiently stiff to support the infant. Alternatively, the infant positioner can be made from a resilient, elastomeric, and shape retaining material with sufficient stiffness to support the infant. The positioner may also be made from fabric filled with cotton or other filling material known to those skilled in the art.

The infant positioner 10 can be made by injecting foam into a mould. The injection of foam material into a mould can create an infant positioner 10 wherein the supports 18 and 14 are integrally formed with the base 12. Various methods of making foam mattresses, pillows, and cushions are well known in the art, and can be used to manufacture preferred embodiments of the present invention. Furthermore, various methods and devices for making one-piece mattresses, pillows, and cushions are known to those skilled in the art, and can be used. For example, methods for producing foam mattresses, pillows, and cushions are disclosed in U.S. Pat. Nos. 4,020,511, 4,207,636, and 4,714,574, which are hereby incorporated by reference.

In another example, the infant positioner can have a cover. The cover can be shaped to contain the infant positioner 10, matching the contours and shape of the infant positioner 10. In some examples, the cover may be washed and reused, while in others the cover may be made of relatively inexpensive, disposable materials. The cover may be made, for example, from fabric (such as cloth), waterproof material, or other such material known to those skilled in the art. The cover may be made of a texture which is comfortable for infant use. In some examples, the cover can be made with a material that sticks to the foam of the infant positioner 10 in a manner which prevents the cover from sliding and/or bunching together beneath the infant's body. The cover may have a zipper, VELCRO®, or other means known to those skilled in the art for securing and removing the cover in relation to embodiments of the infant positioner. Moreover, the cover may contain various designs for aesthetic and/or functional purposes.

Figure 4:
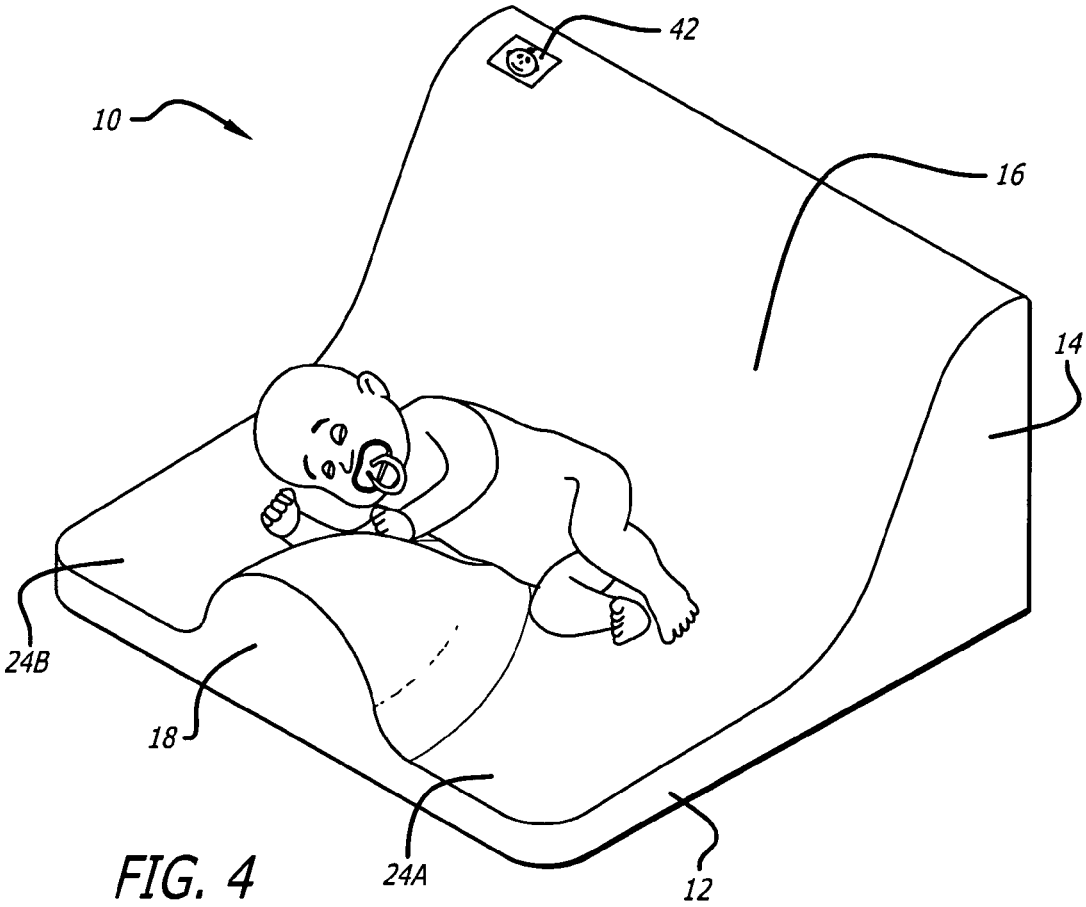
FIG. 4 illustrates an exemplary embodiment of an infant positioner in use, including a position marker.

FIG. 4 shows an infant positioner 10 having a position marker 42 to indicate how to orient the infant when placing the infant into the infant positioner 10. By positioning the infant in various ways during sleep, the risk of plagiocephaly may be reduced. Specifically, by placing the infant on alternating sides during sleep, pressure against the infant's head will be more evenly distributed over time.

The position marker 42 can be placed directly onto the infant positioner 10. Alternatively, the position marker 42 can be placed on the cover. For example, the position marker 42 can show an infant's head on one side, and a foot on the other side. When the position marker 42 is showing the head, then the user may be reminded to orient the infant in the positioner 10 with the infant's head positioned on the same side as the position marker 42. After use, the position marker 42 can be flipped over to show the foot symbol, whereby the user may be reminded to orient the infant with the legs positioned on the same side as the position marker 42. In another example, the position marker 42 is not designed to be flipped over. Rather, the position marker 42 can be moved from one side of the positioner 10 to the other. The position marker 42 can be connected to the positioner 10 in a variety of ways, including but not limited to VELCRO or other attaching means known to those skilled in the art. In some embodiments, the position marker can be integrated into or affixed to the cover. For example, a patch can be sewn onto a fabric cover, or the position marker can be imprinted onto a cover or directly onto the positioner. The position marker 42 can include various symbols, shapes, forms and sizes. For example, stuffed animal toys can be used in preferred embodiments of the position marker 42.

The function of the infant side sleeper is to hold an infant comfortably but securely on its side while it is lying. As shown in FIG. 4, an infant could be placed on its side in the cradle segment 22 between the back support 14 and abdomen support 18. The infant would face the abdomen support 18, with the abdomen support 18 resting against its stomach and it's back supported by the back support 14. A parent can place the infant on alternating sides of the infant's body according to a desired or prescribed schedule.

The previous description of the infant positioner and safety system is provided to enable any person skilled in the art to make or use the infant positioner and safety system. Various modifications to these embodiments will be readily apparent to those skilled in the art, and the generic principles defined herein may be applied to other embodiments without departing from the spirit or scope of the invention. Thus, the infant positioner and safety system is not intended to be limited to the embodiments shown herein but is to be accorded the widest scope consistent with the principles and novel features disclosed herein.

What is claimed is:

1. An infant positioner for positioning an infant on its side, comprising:

a. a first downwardly sloping concave surface configured to provide substantial support to the back of an infant placed against it and having a steepness sufficient to prevent the infant from lying in a supine position, wherein the angle of the slope is within the range of twenty to eight-five degrees; and b. a second upwardly sloping surface configured to support the stomach and/or chest of the infant and having a surface of sufficient size and firmness to prevent the infant from rolling over onto its stomach;

wherein the first and the second sloping surfaces are part of a continuous surface and do not contain any substantially flat portion between them.

2. The infant positioner of claim 1, wherein the positioner has a planar bottom surface.

3. The infant positioner of claim 1, wherein the angle of the slope of the first concave surface is within the range of thirty-five to sixty degrees.

4. The infant positioner of claim 1, further comprising a position marker to record the position of the infant with respect to the positioner.

5. The infant positioner of claim 4, wherein position marker comprises an adhesive material to allow repeated attachment to and removal from the positioner.

* * * * *